US005878448A

United States Patent [19]

Molter

[11] Patent Number: 5,878,448

[45] Date of Patent: Mar. 9, 1999

[54] FLOOR DRAIN EXTENSION

[76] Inventor: Dan E. Molter, 5306 Manatee Ave. West, Bradenton, Fla. 34209

[21] Appl. No.: 455,900

[22] Filed: May 31, 1995

Related U.S. Application Data

[63] Continuation of Ser. No. 333,598, Nov. 2, 1994, abandoned, which is a continuation of Ser. No. 106,238, Aug. 13, 1993, abandoned.

[51] Int. Cl.[6] ..... A47K 3/22

[52] U.S. Cl. ..... 4/613; 4/288

[58] Field of Search ..... 4/286, 288, 292, 4/293, 613; 137/362; 210/164, 165, 163, 166; 52/20, 21; 285/56–60

[56] References Cited

U.S. PATENT DOCUMENTS

| | | | |
|---|---|---|---|
| 1,830,065 | 11/1931 | Luff | 210/165 |
| 1,959,171 | 5/1934 | Mayer | 52/20 X |
| 2,749,999 | 6/1956 | Schmid | 4/288 |
| 2,859,452 | 11/1958 | Seewack | 4/288 X |
| 3,362,425 | 1/1968 | Morris et al. | 137/362 |
| 3,408,778 | 11/1968 | Mason | 52/20 |
| 3,556,993 | 1/1971 | Persson | 210/164 |
| 4,146,939 | 4/1979 | Izzi | 4/286 |
| 4,883,590 | 11/1989 | Papp | 4/288 X |
| 4,943,100 | 7/1990 | Emberson | 210/164 |
| 4,976,568 | 12/1990 | Hess | 52/20 X |

*Primary Examiner*—Robert M. Fetsuga

[57] ABSTRACT

A floor drain extension for, and method of, elevating a drain plate of an existing floor drain after a refinishing layer such as tile has been applied onto the floor structure through which the floor drain is installed. The extension is generally annular shaped and structured to fit between the drain plate and the upper surface of the floor drain fixture so as to upwardly reposition the drain plate into a flush arrangement with the new refinishing layer surface. By proper preselection of the thickness and mounting hole pattern, the extension will easily be reinstalled after the refinishing layer is applied. Further, by temporarily bolting the extension atop the existing floor drain prior to application of the refinishing layer, a precise edge to edge abutting fit between the refinishing layer and the extension will be achieved.

15 Claims, 1 Drawing Sheet

FLOOR DRAIN EXTENSION

This is a continuation of application Ser. No. 08/333,598 filed on Nov. 2, 1994, abandoned, which was a continuation of application Ser. No. 08/106,238 which parent application was filed on Aug. 13, 1993, abandoned.

BACKGROUND OF THE INVENTION

1. Scope of Invention

This invention is directed to adjustable and unadjustable floor drains with drain plates, and more particularly to a floor drain extension for elevating the positioning of a drain plate after applying a refinishing layer atop a floor surface.

2. Prior Art

Typically floor drains in shower stalls, utility rooms and the like are permanently installed into the floor, the lower end of the floor drain extending into a drainage conduit for removal of water from the floor surface. In most, if not all, instances, the floor drain fixture, whether fabricated of metal or molded plastic material, is typically either cast in place within the floor structure or bonded into place with a sealant so as to render the floor drain fixture essentially non-removable after installation. The apertured drain plate is then held onto the open upper end of the floor drain by a plurality of threaded fasteners, the drain plate intended to be positioned generally in flush alignment with the adjacent floor structure.

One such typical floor drain arrangement is shown in U.S. Pat. No. 4,562,602 invented by Cuschera which discloses a wide floor drain adapted to fit a narrow waste pipe. Another conventional non-adjustable drain fitting is disclosed in U.S. Pat. No. 4,730,854 also invented by Cuschera directed to a unique sealable arrangement between the floor drain and the waste pipe.

A plastic floor drain having a self-attaching plastic strainer plate has been invented by Izzi as disclosed in U.S. Pat. No. 4,910,811. Again, this invention is non-adjustable with respect to the upper floor surface. Two other non-adjustable drain fitting arrangements are disclosed in U.S. Pat. No. 3,745,594 invented by Cosper and U.S. Pat. No. 3,742,525 invented by Oropallo.

With age and use (or abuse), these shower floor surfaces become worn and unsightly and it has become a common restoration procedure to apply a refinishing layer such as ceramic tile or a cast in place coating atop these existing shower surfaces. In the process of applying such a refinishing layer of any thickness whatsoever, the drain plate must also be elevated to a new height flush with the new refinishing layer surface. Otherwise, the drain plate will be recessed in the range of e.g. ¼" to ½" below the new refinishing layer surface presenting both an unsightly and a toe stubbing condition.

In such circumstances, the only alternative is to either live with this depression or remove the entire floor drain fixture and install a new one, a difficult and expensive procedure as an added cost for any such floor resurfacing project.

Many floor drains include components which appear to render the upper portion of the floor drain adjustable so as to accommodate just such an eventuality. These devices are disclosed in the following U.S. Patents:

| | |
|---|---|
| Harbeke | 4,964,180 |
| Oropallo | 4,092,745 |

-continued

| | |
|---|---|
| Oropallo | 4,123,810 |
| Izzi | 4,146,939 |
| Izzi | 4,067,072 |

However, because these above seemingly adjustable drain fittings either include additional specific structure for other purposes and/or typically because after installation, the adjustability feature is lost due to the permanent adhesion of the components within the floor, adjustment upwardly of the drain plate mounting surface after initial installation is virtually impossible.

The present invention provides a floor drain spacer or extension of a preselected thickness, diameter and drain plate bolt mounting hole spacing which will fit between the existing floor drain upper exposed surface and the new elevated position of the drain plate after the floor refinishing is completed, thus easily repositioning the drain plate into a flush arrangement with a newly refinished shower or utility room floor surface.

BRIEF SUMMARY OF THE INVENTION

This invention is directed to a floor drain extension for, and method of, elevating a drain plate of an existing floor drain after a refinishing layer such as tile or a cast-in-place coating has been applied onto the floor structure through which the floor drain is installed. The extension is generally annular shaped and structured to fit between the drain plate and the upper surface of the floor drain fixture so as to upwardly reposition the drain plate into a flush arrangement with the new refinishing layer surface. By proper preselection of the thickness and mounting hole pattern, the extension will easily be positioned reinstalled after the refinishing layer is applied. Further, by temporarily bolting the extension atop the existing floor drain prior to application of the refinishing layer, a precise edge to edge abutting fit between the refinishing layer and the extension will be achieved.

It is therefore an object of this invention to provide a floor drain extension which will upwardly reposition a drain plate of a shower or utility room floor drain fixture after a refinishing layer has been applied atop the floor surface.

It is yet another object of this invention to provide a floor drain extension which will accommodate a broad range of bolt hole patterns of existing drain plate and floor drain fixture arrangements.

It is yet another object of this invention to provide an array of thicknesses of floor drain extensions which will accommodate virtually any thickness of refinishing layer applied atop an existing shower floor surface for repositioning the drain plate into a flush arrangement with the new refinishing layer surface.

It is yet another object of this invention to provide a method of repositioning a floor drain plate bolted atop an existing floor drain within a shower floor surface into a flush arrangement with a refinishing layer such as ceramic tile, hardenable cast concrete mixtures or the like applied atop the shower floor surface.

In accordance with these and other objects which will become apparent hereinafter, the instant invention will now be described with reference to the accompanying drawings.

DETAILED DESCRIPTION OF THE INVENTION

Figure 1:
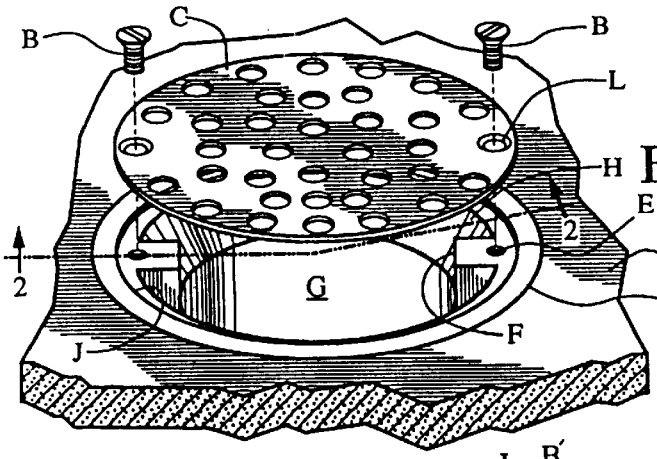
FIG. 1 is a perspective exploded partial section view of a conventional floor drain and drain plate arrangement located within a cast or poured shower or utility room floor structure.
Figure 2:
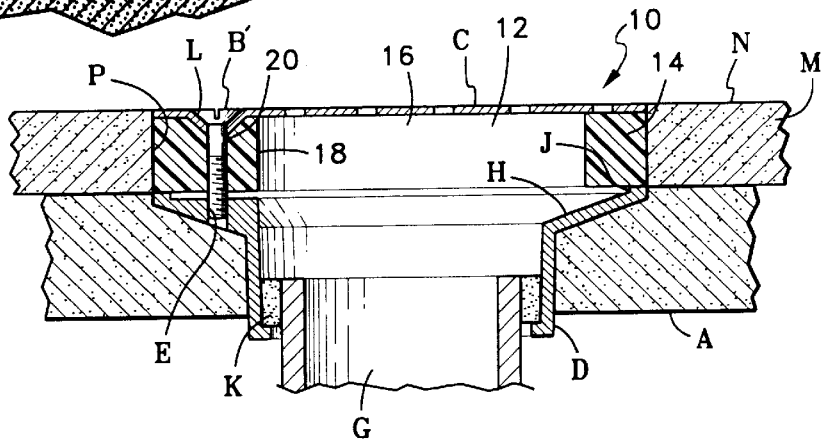
FIG. 2 is a section view in the direction of arrows 2—2 in FIG. 1 with the invention installed after a refinishing layer has been applied atop the existing floor surface.

Referring now to the drawings and firstly to FIGS. 1 and 2, a conventional floor drain fixture is shown generally at D permanently installed within a cast formed or molded shower or utility room floor structure A. The floor drain D includes an upper circular recess J for receiving an apertured drain plate C flushly fitted therein. Threaded bolt holes E formed within inwardly extending ears or lugs F align and register within bolt clearance holes L so as to secure the drain plate C by threaded fasteners B in position flush atop the floor drain D. A waste conduit G extends downwardly from the floor drain D, sealed thereto at K.

Figure 3:
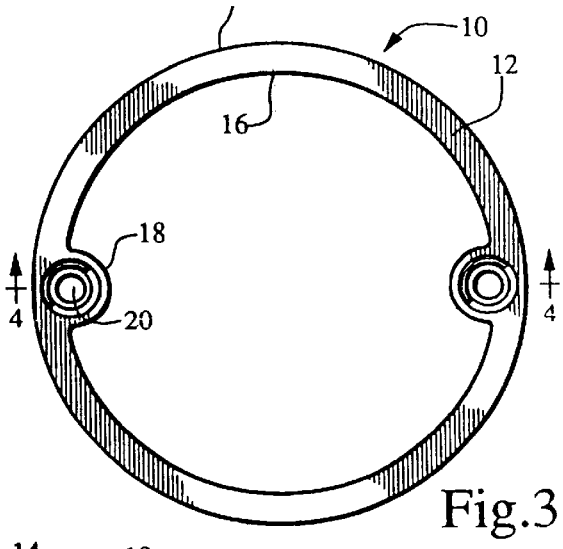
FIG. 3 is a top plan view of the preferred embodiment of the invention.
Figure 4:
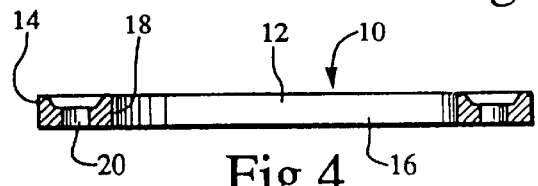
FIG. 4 is a section view in the direction of arrows 4—4 in FIG. 3.

Referring additionally to FIGS. 3 and 4, the preferred embodiment of the invention is shown generally at numeral 10 in position atop the floor drain D after a refinishing layer M has been applied atop the existing floor structure A. Typically, this refinishing layer M may be in the form of a ceramic tile, a cast in place concrete or composite mixture or the like which establishes a new, elevated exposed surface N of the shower or basin floor area A.

The device 10 is integrally molded of a plastic or composite material and includes an annular or ring-shaped body 12 having spaced upright coaxial outer and inner surfaces 14 and 16, respectively. These surfaces 14 and 16 are preferably smooth. The horizontal upper and lower surfaces of the annular body 12 define a thickness which is preferably equal to that of the new refinishing layer M when the drain plate C is positioned directly atop the upper surface of the device 10.

Inwardly extending ears or mounting lugs 18 provide an additional material thickness through which smooth upright bolt holes 20 are formed having a symmetric rotational orientation in the plan view of FIG. 3 and a symmetric spacing therebetween which aligns with the threaded holes E of the floor drain D and the aligning bolt holes L of drain plate C. Where the bolt holes L are chamfered downwardly as shown in FIG. 2, the bolt hole 20 will also include a similar mating chamfered area at the upper end of the bolt hole 20 as shown. By this arrangement, the drain plate C will closely mate directly against the upper surface of the device 10 with the respective bolt holes in alignment and registry one to another. The bottom lower surface of the device 10 will then mate against the exposed surface of the floor drain D. To secure this arrangement, a slightly longer threaded fastener B' will be required which will pass through the entire thickness of the drain plate C stacked atop the device 10 for threadable engagement into threaded holes E of the drain fixture D.

Where the refinishing layer M is of a ceramic tile nature where individual pieces are set into place, a clearance cavity P is provided to mate around the outer cylindrical surface 14 of the device 10. Clearance may be provided for a sealant material therebetween. Alternately, where the refinishing layer M is of an in-situ cast or poured material nature which will harden in place, the device 10 may be temporarily bolted into position atop the floor drain D and the material then cast therearound. Thereafter, the mounting bolts B' may be removed and the drain plate C then installed after the refinishing layer M has hardened and cured.

Figure 5:
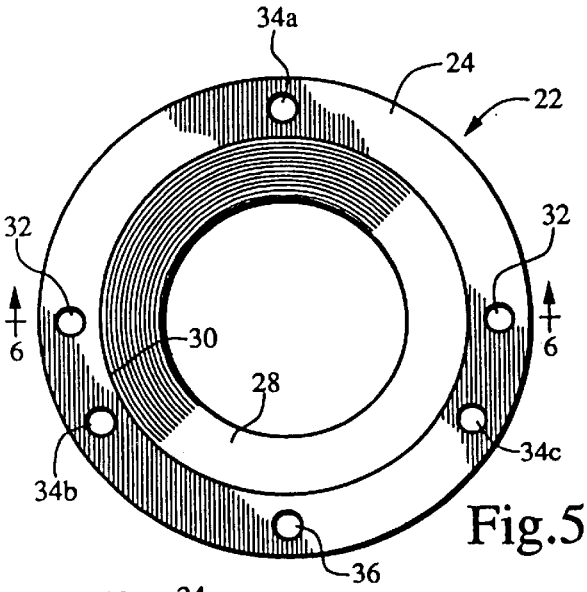
FIG. 5 is a top plan view of an alternate embodiment of the invention.
Figure 6:
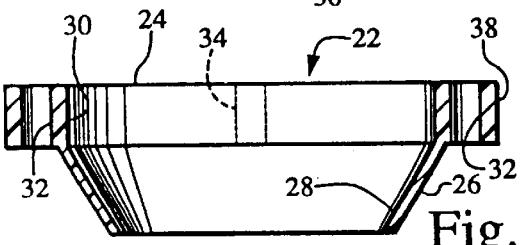
FIG. 6 is a section view in the direction of arrows 6—6 in FIG. 5.

Referring to FIGS. 5 and 6, an alternate embodiment of the invention is there shown generally at numeral 22. This molded plastic embodiment 22 also includes an annular or ring-shaped body 24 having concentric upright inner an outer cylindrical surfaces 30 and 38, respectively, and having spaced horizontal upper and lower surfaces defining a preselected thickness equal to generally that of the refinishing layer to be applied atop the existing shower or utility floor surface as previously described. This embodiment 22 further includes a truncated funnel shaped lower extension 26 defining an inner surface 28 which will fit within the existing floor drain fixture on a more universal basis and inwardly direct the water flowing therethrough downwardly into waste conduit G as previously described.

This embodiment 22 also includes a universal bolt hole pattern which will accommodate a wide variety (if not all) of existing floor drains. Bolt holes 32 are diametrically opposed one to another to accommodate a two bolt hole pattern. The addition of orthogonally oriented bolt holes 34*a* and 36 will accommodate a symmetric four bolt hole pattern, while bolt holes 34*b* and 34*c*, in combination with bolt hole 34*a* will accommodate a symmetric three bolt hole pattern of the exiting drain fixture D.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A floor drain extension separate from and adapted to fit between a conventional non-adjustable integrally formed floor drain being permanently secured within an existing floor surface and an apertured drain plate in conjunction with a refinishing layer being applied atop the existing floor structure, the refinishing layer extending over the floor structure and up to said drain extension but not over the floor drain, said floor drain extension consisting of:

a generally rigid annular body having generally parallel spaced horizontal upper and lower surfaces, said annular body having a vertical thickness generally equal to a thickness of the refinishing layer;

said annular body also having a generally cylindrical upright outer surface defining an outer periphery of an upper exposed surface of the floor drain when said annular body is positioned atop the floor drain;

said annular body also having an upright generally circular smooth inner surface defining an entirely open central region sized for freely allowing liquid to flow by gravity from atop the refinishing layer into the floor drain;

said annular body also having a plurality of upright smooth-wall bolt holes therethrough alignable with a plurality of drain plate mounting holes formed through the drain plate;

said annular body being mateable against and connectable directly atop the floor drain upper surface and the drain plate being connectable atop said annular body upper surface only by a threaded fastener passing through each said bolt hole and each mounting hole of said plurality of drain plate mounting holes for threaded engagement of the threaded fastener into an existing upright threaded aperture formed into the floor drain upper surface wherein the drain plate is positioned and secured flush with an upper surface of the refinishing layer.

2. A floor drain extension as set forth in claim 1, wherein:

each said bolt hole is formed through an ear which extends inwardly into said open central region from said inner surface.

3. A floor drain extension as set forth in claim 1, further comprising a funnel shaped portion downwardly extending from said inner surface into the floor drain for convergingly directing liquid into the floor drain.

4. A floor drain extension as set forth in claim 3, wherein said plurality of bolt holes includes at least two symmetric hole patterns for alignment with at least two different hole patterns in different drain plates.

5. A Method of repositioning and resecuring a drain plate atop a conventional fixed in place non-adjustable integrally formed floor drain when a refinishing layer is applied over a floor structure into which said floor drain is connected, said refinishing layer extending up to, but not over, said floor drain, comprising the steps of:

a. positioning an annular body directly atop an upper exposed surface of said floor drain, said annular body comprising:

generally parallel spaced horizontal upper and lower surfaces, said annular body having a vertical thickness generally equal to a thickness of the refinishing layer;

said annular body also having a generally cylindrical upright outer surface defining an outer periphery of an upper exposed surface of the floor drain when said annular body is positioned atop the floor drain;

said annular body also having an upright generally circular smooth inner surface defining an entirely open central region sized for freely allowing liquid to flow by gravity from atop the refinishing layer into the floor drain;

said annular body also having a plurality of upright smooth-wall bolt holes therethrough alignable with a plurality of drain plate mounting holes formed through the drain plate;

b. positioning said drain plate atop said annular body upper surface;

c. passing a threaded fastener through each said bolt hole and each mounting hole of said plurality of drain plate mounting holes and threadably engaging each said threaded fastener into an upright threaded aperture formed into the floor drain upper surface wherein the drain plate is positioned and secured flush with an upper surface of the refinishing layer.

6. A floor drain extension as set forth in claim 5, wherein:

each said bolt hole is formed through an ear which extends inwardly into said open central region from said inner surface.

7. A floor drain extension as set forth in claim 5, wherein said annular body further comprises:

a funnel shaped portion downwardly extending from said inner surface into the floor drain for convergingly directing liquid into the floor drain.

8. A floor drain extension as set forth in claim 7, wherein said plurality of bolt holes includes at least two symmetric hole patterns for alignment with at least two different hole patterns in different drain plates.

9. A Method of repositioning and resecuring a drain plate atop a conventional fixed in place non-adjustable integrally formed floor drain in conjunction with applying a refinishing layer over a floor structure into which said floor drain is connected, said refinishing layer extending up to, but not over, said floor drain, comprising the steps of:

a. removing said drain plate from atop said floor drain;

b. selecting an annular body generally equal in thickness to that of the refinishing layer, said annular body comprising:

generally parallel spaced horizontal upper and lower surfaces, said annular body having a vertical thickness generally equal to a thickness of the refinishing layer;

said annular body also having a generally cylindrical upright outer surface defining an outer periphery of an upper exposed surface of the floor drain when said annular body is positioned atop the floor drain;

said annular body also having an upright generally circular smooth inner surface defining an open central region sized for freely allowing liquid to flow by gravity from atop the refinishing layer into the floor drain;

said annular body also having a plurality of upright smooth-wall bolt holes therethrough alignable with a plurality of drain plate mounting holes formed through the drain plate;

c. positioning said annular body directly atop an exposed upper surface of said floor drain;

d. positioning said drain plate atop said annular body upper surface;

e. passing a threaded fastener through each said bolt hole and each mounting hole of said plurality of drain plate mounting holes and threadably engaging each said threaded fastener into an upright threaded aperture formed into the floor drain upper surface wherein the drain plate is positioned and secured flush with an upper surface of the refinishing layer; and f. applying the refinishing layer atop the floor structure up to an upright outer perimeter of said annular body.

10. A floor drain extension comprising:

an annular ring having a lower planar surface, an upper planar surface, and a round outer surface bound by said upper and lower planar surfaces, and an inner, generally circular surface, a pair of oppositely located bores extending through said annular ring from said upper planar surface and extending completely through said lower planar surface, said inner surface curving inwardly to accommodate for said pair of bores and to provide an even amount of material surrounding said bores, said bores including chamfers adjacent said upper planar surface.

11. A floor drain extension combination including the floor drain extension of claim 10 and further comprising a floor drain plate having a pair of oppositely disposed bores which align with said bores of said floor drain extension when said floor drain plate is placed over and in alignment with said floor drain extension, said floor drain plate secured to said floor drain extension.

12. A floor drain extension combination including the floor drain extension and floor drain of claim 11 and further comprising:

a conventional floor drain having a pair of oppositely disposed and threaded bores which align with said bores of said floor drain extension and said bores of said floor drain plate when said floor drain is placed over and in alignment with said floor drain extension; and a pair of threaded fasteners, each threaded fastener extending through an associated bore of said floor drain plate and thence extending through an associated bore of said floor drain extension and thence extending into and threadably engaged by said threaded bores of said conventional floor drain to thereby secure said floor drain plate to said floor drain extension.

13. The floor drain extension of claim 10 wherein said round outer surface of said floor drain extension is a straight cylindrical outer surface.

14. The floor drain extension of claim 10 wherein the curving inwardly of said inner surface adjacent said pair of oppositely located bores is a radially innermost extent of said floor drain extension.

15. The floor drain extension of claim 10 wherein said inner generally circular surface is a straight axial surface and extends between said upper and said lower planar surfaces.

* * * * *